US005080760A

United States Patent [19]

Smith et al.

[11] Patent Number: 5,080,760

[45] Date of Patent: Jan. 14, 1992

[54] PRESSURIZED FORMING BOARD

[75] Inventors: David T. Smith, Monson, Mass.; Douglas R. McPherson, Windsor, Conn.; Richard E. Pitt, Carleton Place, Canada

[73] Assignee: JWI Ltd., Ontario, Canada

[21] Appl. No.: 660,855

[22] Filed: Feb. 26, 1991

Related U.S. Application Data

[63] Continuation-in-part of Ser. No. 362,925, Jun. 8, 1989, abandoned.

[51] Int. Cl.[5] ..... D21F 1/20; D21F 1/54

[52] U.S. Cl. ..... 162/351; 162/352; 162/354; 162/211

[58] Field of Search ..... 162/208, 211, 297, 352, 162/354, 351, 348, 209

[56] References Cited

U.S. PATENT DOCUMENTS

| | | | |
|---|---|---|---|
| 2,991,218 | 7/1961 | Cirrito et al. | 162/370 |
| 2,995,186 | 8/1961 | Montigny | 162/297 |
| 3,066,068 | 11/1962 | Calehuff et al. | 162/208 |
| 3,149,026 | 9/1964 | Hornbostel | 162/208 |
| 3,311,533 | 3/1967 | Montigny et al. | 162/203 |
| 3,438,854 | 4/1969 | Means | 162/354 |
| 3,574,998 | 4/1975 | Johnson | 162/211 |
| 3,846,233 | 11/1974 | Kankaanpaa | 162/208 |
| 3,981,768 | 9/1976 | Lehtinen | 162/199 |
| 4,235,667 | 11/1980 | Bergstrom et al. | 162/203 |
| 4,306,934 | 12/1981 | Seppanen | 162/209 |
| 4,315,799 | 2/1982 | Turek et al. | 162/352 |
| 4,734,164 | 3/1988 | Irwin et al. | 162/348 |
| 4,802,954 | 2/1989 | Malashenko | 162/348 |

*Primary Examiner*—Karen M. Hastings

*Attorney, Agent, or Firm*—Cushman, Darby & Cushman

[57] ABSTRACT

A paper making machine forming board is described wherein the rate of drainage of the stock through the forming fabric is curtailed and controlled by applying a low positive air pressure (above ambient atmospheric) to the machine side of the forming fabric. Additionally, a controlled level of agitation is induced in the stock on the forming board, providing better initial paper formation.

23 Claims, 5 Drawing Sheets

PRESSURIZED FORMING BOARD

RELATED APPLICATION

This application is a Continuation-In-Part of Ser. No. 07/362,925 filed June 8th, 1989 now abandoned.

This invention is concerned with the initial formation of paper on machines of the type wherein an aqueous slurry known as the stock is deposited onto a continuous moving forming fabric In this type of machine, the stock which contains both fibers and other substances in an amount of from about 0.1% to about 1.5% by weight, is fed from a head box slice onto a moving forming fabric Water is progressively drained from the stock through the forming fabric as it passes over various drainage elements until at the end of the forming section the stock contains some 2% to 4% by weight of solid material. At that point, the distribution and orientation of the fibers and other solids in the still very wet stock is largely determined, and will not change very much in the later paper making steps. Thus at the end of the forming section the formation of the paper is largely completed.

In outline, a conventional paper making machine forming section includes a forming fabric which is supported at the head box slice end by a breast roll, which is followed in sequence by a forming board, and thereafter by a group of drainage devices which complete the forming section. The nature and placement of these drainage devices varies considerably, and is determined at least in part by whether either a conventional open fabric forming section or a twin wire or gap former is being used.

It is well known that the jet of stock delivered onto the forming fabric from the head box slice is often far from uniform. In a uniform stock, all of the various components therein would be evenly and uniformly distributed throughout. Similarly, the jet of stock that exits the head box slice would also be of constant depth, constant linear velocity, and free from ripples and other disturbances across the full width of the head box slice. These ideals are rarely, if ever, achieved in practice Within the stock itself, there is also significant point-to-point variation in the distribution of the various materials in the stock, in both a vertical and a horizontal direction. It is desirable that these imperfections in the stock should either be removed or at least controlled so that they get no worse, before they are set into the paper web as a consequence of water drainage from the stock in the forming section. Actual paper making machine measurements show that typically 30% to 50% of the headbox flow is drained through prior art forming boards. This high and uncontrolled rate of drainage in the initial part of a forming section sets these stock imperfections into the formation of the paper. This effectively precludes any remedial action.

It has now been realized that if this very high rate of drainage in the initial part of the forming process could be curtailed, then an improvement in the overall paper making process will result. The remaining drainage elements in the forming section must of course be able to handle the increased drainage load that such a step will cause.

The concepts of this invention are equally applicable to both a twin wire machine, and to a conventional open-surface forming section, that is to improve stock formation in the region of the forming section immediately adjacent the head box slice.

Curtailing the drainage rate through a conventional design forming board would appear to be simple: all that is needed is to decrease the available drainage area, by widening the support surfaces, and/or moving them closer together. Experiment shows that this is not so and the drainage rate is not significantly reduced. Further, the paper web is marked severely with streaks, of uneven fibre weight across the width of the paper. In other words, such changes can cause significant deterioration in paper quality.

It has now been discovered that these difficulties can be overcome, and a much reduced rate of drainage obtained, by changing the construction of the forming board and its associated drainage chamber(s) in such a way that a low value of air pressure above ambient atmospheric is applied to the machine side of the forming fabric. Additionally, the fabric support blades are constructed to induce some beneficial agitation within the stock by careful choice of the support blade profile.

Thus in a first broad embodiment, this invention provides in a paper making machine having a forming section, including at least a continuous travelling forming fabric which passes over a breast roll adjacent a head box having a head box slice adapted to deliver a jet of aqueous stock onto the forming fabric to provide a layer of stock on the forming fabric, an apparatus for improving paper formation consisting essentially of in combination:

(a) a foraminous forming board support surface for the forming fabric, and which extends from a point adjacent the head box slice;

(b) a drainage means for the foraminous forming board support surface; and (c) an air supply means, including air pressure pump means and air pressure control means whereby the air pressure in the drainage means is controlled;

wherein:

(i) the drainage means extends to the end of the forming board support surface;

(ii) the drainage means is chosen from the group consisting essentially of:

a single drainage box comprising a single compartment provided with an air supply means and an air pressure tight drainage means;

a single drainage box divided into a plurality of separate compartments by a plurality of air tight divisions extending across the width of the drainage box, each compartment of which is provided with a separate air supply means and a separate air pressure tight drainage means; and a plurality of separate contiguously adjacent drainage boxes which in effect form a plurality of separate compartments, each of which extends across the width of the forming fabric, and each of which is provided with a separate air supply means and a separate air pressure tight drainage means;

(iii) the air supply means together with the air pressure tight drainage means is structured and arranged to provide in each compartment an air pressure above ambient atmospheric pressure sufficient to hinder water drainage from the stock through the forming fabric but insufficient to interfere with paper formation on the forming fabric;

(iv) the forming board support surface provides apertures through which the forming fabric drains and a path through which the forming fabric moves which will cause a controlled level of continuous agitation in the stock on the forming fabric, and provides an air pressure tight seal between each compartment and the forming fabric;

(v) the forming board support surface includes a plurality of static support elements uniformly spaced so as to induce agitation in the stock;

(vi) the static support elements comprise a plurality of thin elongate blades having top fabric supporting faces extending across the full width of the forming fabric, together with sealing strips interposed between the ends thereof adjacent the lateral edges of the fabric;

(vii) the static support elements include at least one static support element having a top support face for the forming fabric which contributes to the desired level of agitation in the stock, and which comprises a flat surface having a leading and a trailing portion in the direction of forming fabric travel separated by at least one shallow depression extending along the blade for the width of the forming fabric and wherein each of the leading and trailing portions, and of any flat portions intermediate shallow depressions, is of sufficient width in the direction of forming fabric travel to provide a hydraulic seal to the forming fabric; and (viii) one of the plurality of thin elongate blades is placed above the first and the last walls of the drainage means, and over any internal transverse division or pair of contiguous transverse walls in the drainage means.

In a second preferred embodiment, the positive pressure will generally decrease from a maximum value adjacent the head box slice to a value approaching ambient atmospheric pressure at the end of the forming board surface. In this embodiment, the drainage means will comprise a plurality of compartments. The forming board surface preferably comprises a plurality of thin elongate blades extending across the full width of the forming fabric, so placed as to contribute toward controlled agitation of the stock on the forming fabric. The thin elongate blades are provided with a top surface contour which will enhance, maintain or diminish controlled agitation in the stock on the forming fabric.

In a third preferred embodiment, this invention provides a method for improving stock formation on the forming fabric of a paper making machine which includes a forming fabric supported adjacent the head box slice by a forming board, which method comprises applying to the machine side of the forming fabric over the length of the forming board a controlled positive air pressure above ambient atmospheric sufficient to hinder water drainage through the forming fabric, without interfering with paper formation on the forming fabric.

Preferably, the positive pressure is controlled from a high value adjacent the head box slice, to a low value approaching ambient atmospheric pressure at the end of the forming board, and which correlates to the decreasing stock layer thickness of the forming fabric.

Preferably, the air pressure is controlled to be from about 1 cm water gauge (above ambient atmospheric) to about 25 cms water gauge.

BRIEF DESCRIPTION OF THE DRAWINGS

The invention will now be described in more detail by way of reference to a conventional open-surface forming section. It is to be understood that the invention is not so limited, and may be used with other paper making machines of the 2 wire, twin-wire, or gap former type. In the attached drawings.

In these Figures, relevant like parts have been given the same numbers.

DETAILED DESCRIPTION OF THE DRAWINGS

Figure 1:
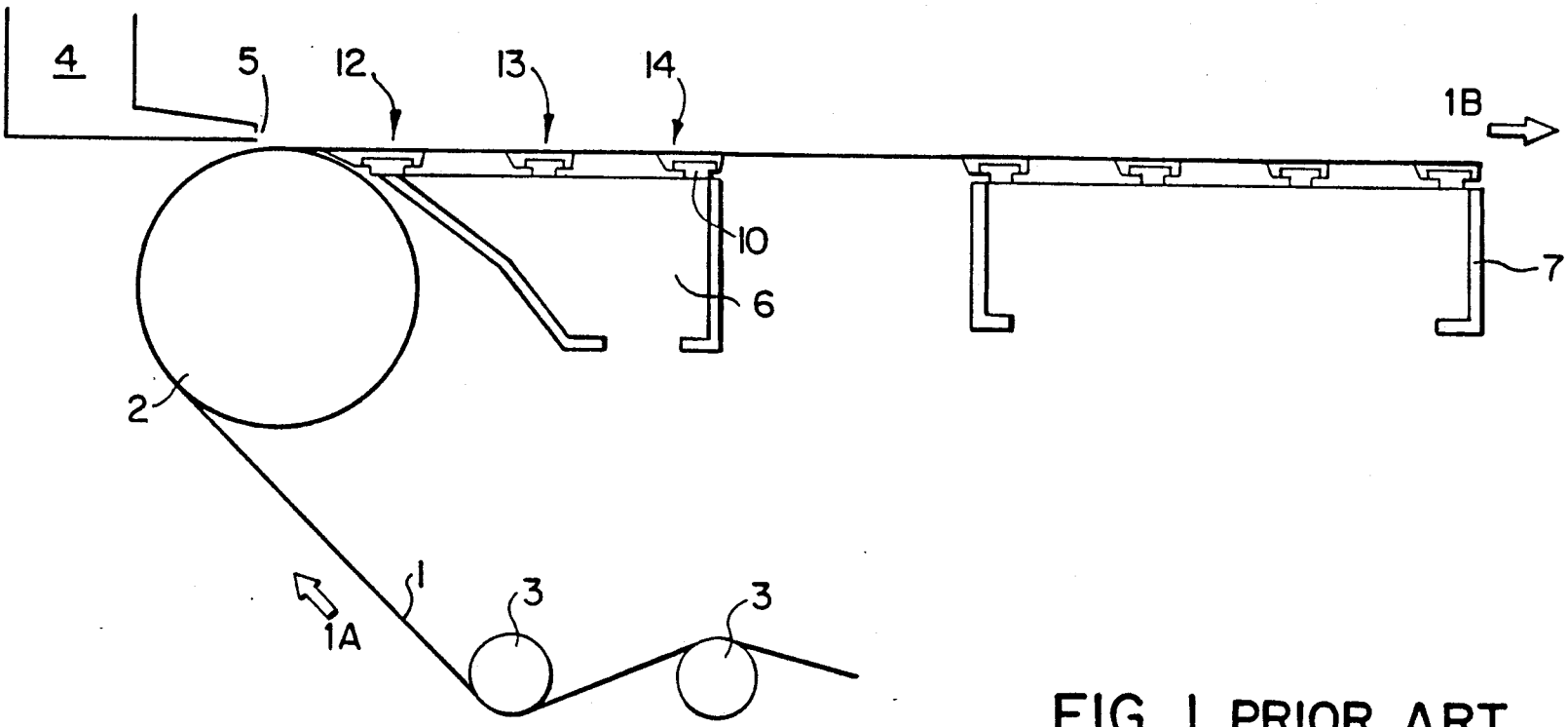
FIG. 1 PRIOR ART
FIG. 1 shows diagrammatically the initial part of a Fourdrinier paper making machine.

In FIG. 1, the initial part of a conventional paper making machine is shown, incorporating a forming fabric 1, which moves in the direction of the arrows shown at 1A and 1B. The forming fabric moves over a breast roll 2, and various tensioning and idling rollers 3. The stock is deposited onto the forming fabric 1 from the head box shown diagrammatically at 4, through a head box slice 5, which extends transversely across the forming fabric 1.

Adjacent the breast roll 2 and the head box slice 5 is a forming board followed by the first of the many stock dewatering units which comprise the forming section, which in this case is shown as a foil unit 7, based on that originally described by Wrist in U.S. Pat. No. 2,928,465.

The forming board unit 6 is provided with a plurality of support surfaces shown generally at 12, 13 and 14, of which that nearest the headbox slice, 12, is generally wider than the others. Each of these surfaces is mounted on a T-bar, as at 10. As shown, the drainage box 6 is merely left open at its bottom to provide gravity drainage.

Figure 2:
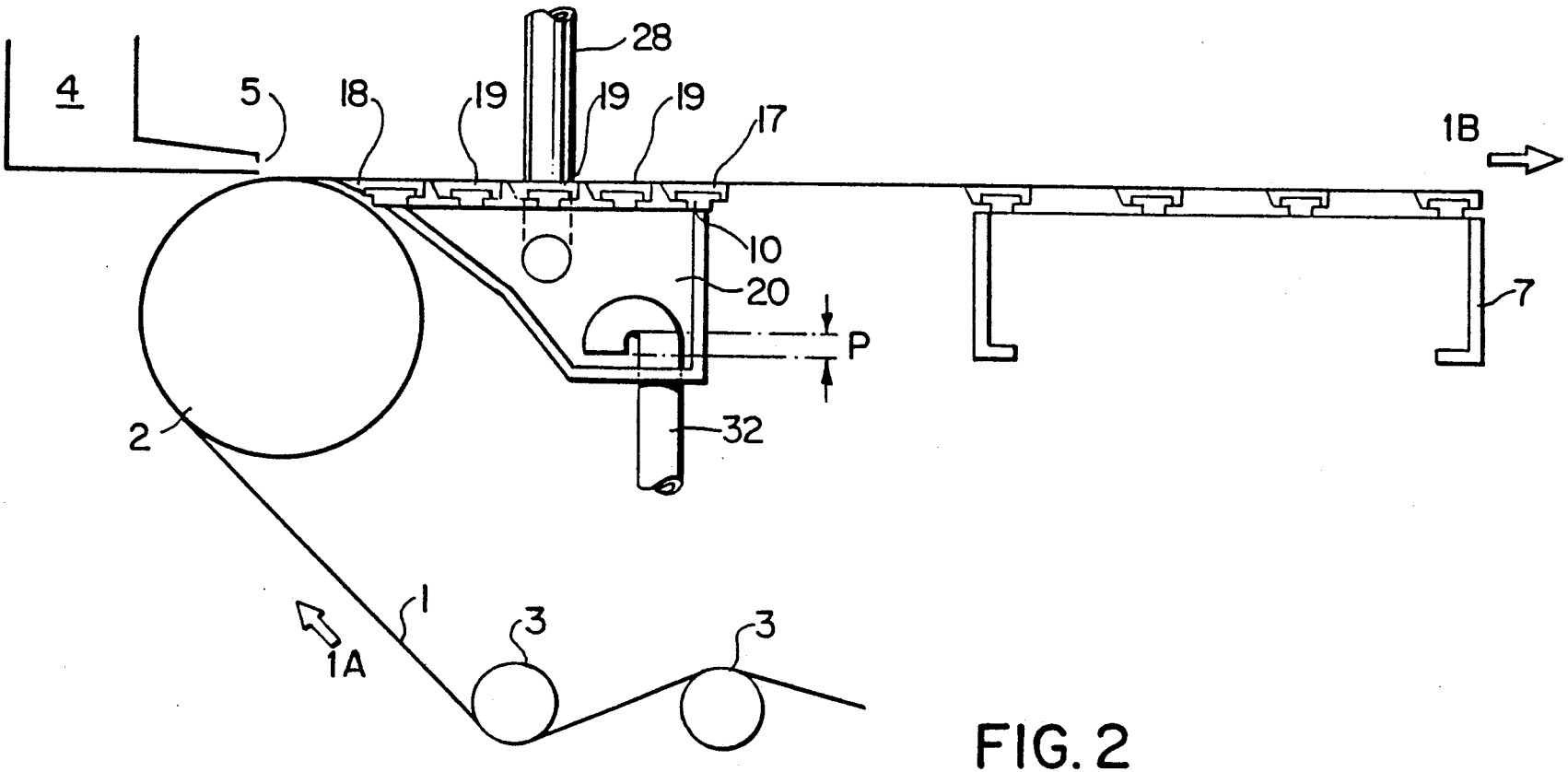
FIG. 2 shows schematically one forming board of this invention.

In FIG. 2 is shown a simple embodiment of a forming board of this invention. There are several differences to the construction shown in FIG. 1. The drainage means is now a closed box, provided with a pressurized air pressure supply pipe 28, and a pressure tight drain 32. As shown, this is a return leg located above the bottom of the box: other arrangements are possible. The height of the return leg as shown in FIG. 2 will determine the pressure, P, which can be applied in the box, since higher pressures will destroy the seal and blow the water out of the drainage box. The manner in which a suitable value for P is determined will be discussed below. The forming fabric support surface again comprises a group of T-bars, as at 10, onto which are fitted the various thin elongate blades 17, 18 and 19. At each side of the forming fabric sealing pieces (not shown) are inserted between the elongate blades to seal the edges of the forming fabric to the forming board surface on the drainage box.

The shape and placement of the blades 17, 18 and 19 is important.

The last one, blade 17, has to be placed over the end wall of the drainage box in order to provide the required air pressure tight seal.

The first blade 18 has to counter the impact of the jet of stock as it exits the slice 5 onto the forming fabric 1. Conventionally as shown in FIG. 2, this first blade is usually much wider than the others, often being twice the width of the later ones. It has now been found that this need not be so, and a blade substantially the same width as the others can often be used. This first blade will also generally have a flat top surface As is the case with all of the blades, it is mounted onto a conventional T-bar arrangement. This blade also has to be placed over the wall of the drainage box, again in order to provide the required air pressure tight seal.

The placement, and the shape, of both blade 17 and the blades 19 is important. It is now known that almost any static surface used to support a forming fabric has some effect on the agitation in the stock on the fabric. Although the hydraulic phenomena causing the agitation are not fully understood, careful observation has shown that even a simple flat surface was an effect on the agitation in the stock. The characteristics of the fabric supporting surface can be chosen to produce agitation in the stock which can range from sufficient to lift the stock bodily off the fabric ranging downwardly through visible macroscopic agitation to microscopic agitation which can only be observed by using careful photography and strobe light illumination.

Further, it has now been realized that the placement of these blades along the forming board is important. All of the blades 19 can be spaced apart so that the microscopic and/or macroscopic agitation associated with each of them is regularly spaced. The blades 19 can be spaced apart such that the agitation builds up over successive blades to a level that does not significantly decay between the blades, and thus becomes essentially continuous. It then follows that the careful choice of both the placement and surface profile of any one blade controls the amount of agitation at that point along the forming board Further, although it follows that all of the blades will be regularly spaced, it does not follow that all of the blades will be set at the same spacing: some contiguous groups of blades may be different and set at wider or narrower spacing than others.

The blade-to-blade spacing, and the blade support surface shape must be so chosen as to realize three key objectives:

(i) the support surface shape is chosen to enhance, maintain, or diminish, the agitation induced at any given area of the forming board.

(ii) the stock agitation frequency obtained in any given area of the forming board is sufficient to improve formation; and (iii) the stock agitation should be continuous for the full length of the forming board with no areas in which the agitation decays to an undesirably low value.

Thus one of the key benefits of this invention is that a continuous and controlled level of agitation is readily generated and maintained in the stock on the forming board in the very early stages of paper fiber mat formation. Once this is done, paper formation can be further improved by actively restricting the rate at which the stock is allowed to drain on the forming board. Because the stock drains through the incipient paper mat, and also because the paper mat is compressible, decreasing the drainage rate results in lower mat compression, lower mat resistance to drainage, and better paper formation.

The effect of each blade is largely determined by the shape of the support surface. A simple flat surfaced blade propagates some agitation in the microagitation range; however, in most instances, a flat surface will not improve formation. Ideally, a blade used to provide microagitation in the stock will cause low or zero drainage. Suitable blade types are described by Johnson in U.S. Pat. No. 3,874,998 and by Saad in U.S. Pat. No. 4,420,370. These blades can be constructed using the now standard T-bar support concepts. This invention does not preclude the use of devices which cause some drainage as well as providing the desired amount of agitation.

Figure 3B:
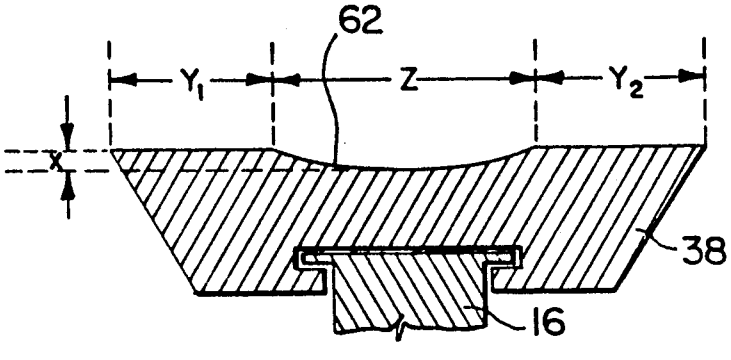
FIG. 3A, 3B and 3C each show different possible support surfaces of the forming board of FIG. 2.
Figure 3C:
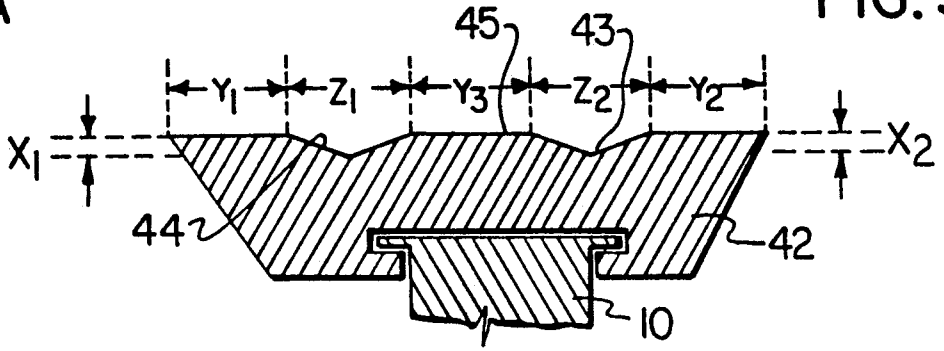
Figure 3A:
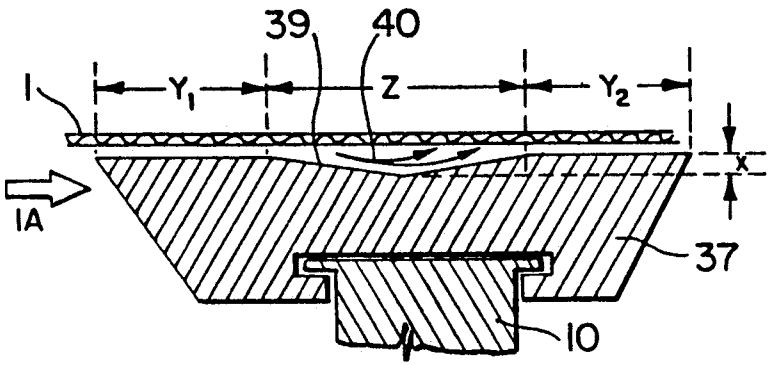

FIGS. 3A, 3B and 3C show blades which agitate without draining, as described by Johnson, in U.S. Pat. No. 3,874,998. In each case, the blade 37, 38 or 42 mounts on a T-bar 10. Referring first to FIG. 3A, the blade 37 has a central depression 39, in its top surface, so that a cross-machine gap of a flat triangular shape, having a depth x, is created below the plane of the forming fabric. Alternatively, as shown in FIG. 3B at 41, this depression rather than being triangular, can be a shallow concave shape. In both cases, as is shown in FIG. 3A, water enters this depression from the stock on the forming fabric 1, and re-enters the stock, as indicated by the arrows 40 in FIG. 3A.

FIG. 3C shows a further alternative arrangement in which the blade 42 is again mounted on a T-bar 10. As shown, this blade has two depressions 42 and 43 of depths $x_1$, and $x_2$, respectively. These depressions are of widths $z_1$, and $z_2$, respectively, and are separated by another intermediate flat portion 45 having a width $y_3$. Generally each of the depressions are about the same width ($z_1$, and $z_2$ the same) and each of the leading, trailing, and intermediate flat portions are about the same width (that is, $y_1$, $y_2$ and $y_3$ the same) and each of the flat portions are about one half the width of the depressions (that is, for example, $y_1$ is one half of $z_1$).

Careful choice of the distances x, $y_1$, $y_2$ and z then controls the amount of agitation imparted to the stock. The amount of agitation that is needed at this early stage of paper formation is small, in the microagitation range mentioned earlier, and therefore it is possible that not all of the blades will have a depression.

Typical dimensions for a blade such as those shown in FIGS. 3A, 3B or 3C when used to cause microagitation are:

(i) total width (i.e. $y_1+y_2+z$): 25 mm to 75 mm (ii) flat surface width: generally $y_1$ and $y_2$ are equal, but are not necessarily so; the minimum for each is about 5 mm, with a minimum of 10 mm being preferred (iii) the width, z, of the depression: 15 mm to 65 mm (iv) the depth, x, of the depression: 0.25 mm to 2.5 mm, for both a triangular and a curved depression.

These dimensions are given as exemplary and do not limit the scope of the invention as other dimensions may be found useful in particular circumstances.

The preferred value for the depression width z is that it is about half the total width of the blade. This then leaves adequate leading and trailing flat portions ($y_1$ and $y_2$) to get a water seal with the fabric onto the blade in these areas. As the depth also affects the amount of agitation, a wider blade will not necessarily require a deeper depression. In many cases it is found that if the blade is widened then the depth, x, should not be changed, although the width z will increase, to maintain it at about half the total blade width. In selecting a blade for a given circumstance, some care is needed. The narrowest blade that gives adequate support should be used, which will mean that a forming board according to this invention usually will use more support blades than a conventional board. Further, all of the blades used can be of the same width. Similarly, the shallowest depression should be used that is needed to cause the desired amount of agitation. If the blade is made too wide, and the depression is made too deep, then the level of agitation can go far beyond the microagitation needed in this area of the forming fabric to a level where the forming fabric with the stock on it lifts clear of the blades. This is not conducive to the making of good paper.

Figure 4:
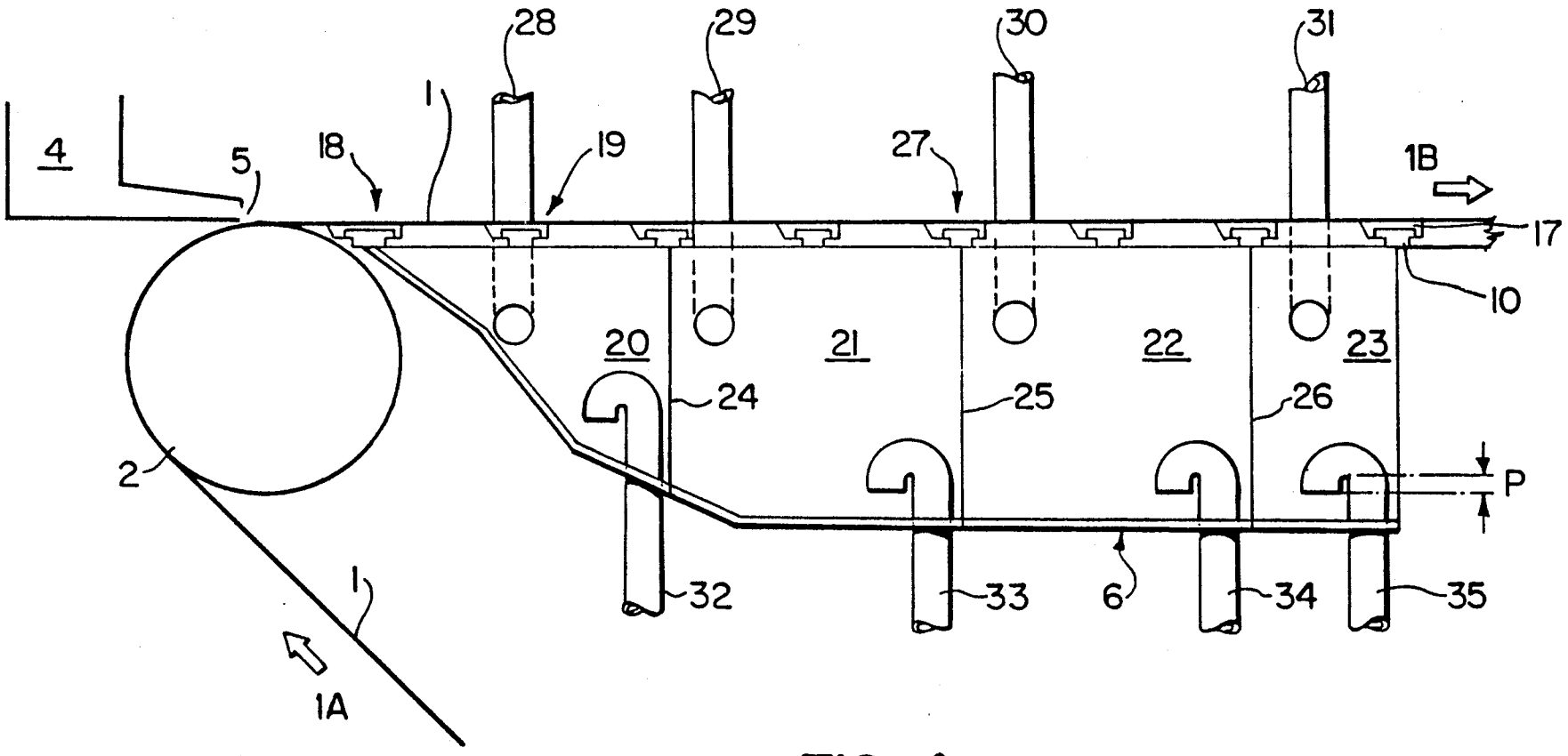
FIG. 4 shows schematically an alternative forming board of this invention.

In FIG. 4 an alternative embodiment is shown. The drainage box shown generally at 6 is divided into a series of pressure tight smaller compartments 20, 21, 22, and 23, by transverse walls 24, 25 and 26. Four are shown, but the actual number, and their length, will depend on the conditions prevailing on a given paper making machine. Similarly, a series of separate boxes could also be used, with their side walls contiguous. Each of the compartments 20 through 23 extends across the full width of the forming fabric. In each case, a blade, as at 27, is placed over each of the transverse walls. Each of the compartments is provided with a pressurized air supply pipe 28, 29, 30 and 31, which incorporates a pressure control means (not shown), and also with a drainage leg 32, 33, 34 and 35, which includes suitable means to contain pressure in the compartment while also allowing free drainage. This arrangement permits a different marginal pressure above ambient to be applied to each of boxes 20, 21, 22 and 23.

The amount of pressure which can be utilized in the method of this invention must be limited to a value which will not interfere with paper formation on the forming fabric, and is controlled by a complex set of variables. If the applied pressure is too high, the seal in the water leg 32 can be blown out, and the stock can be lifted off the forming fabric.

Figure 5:
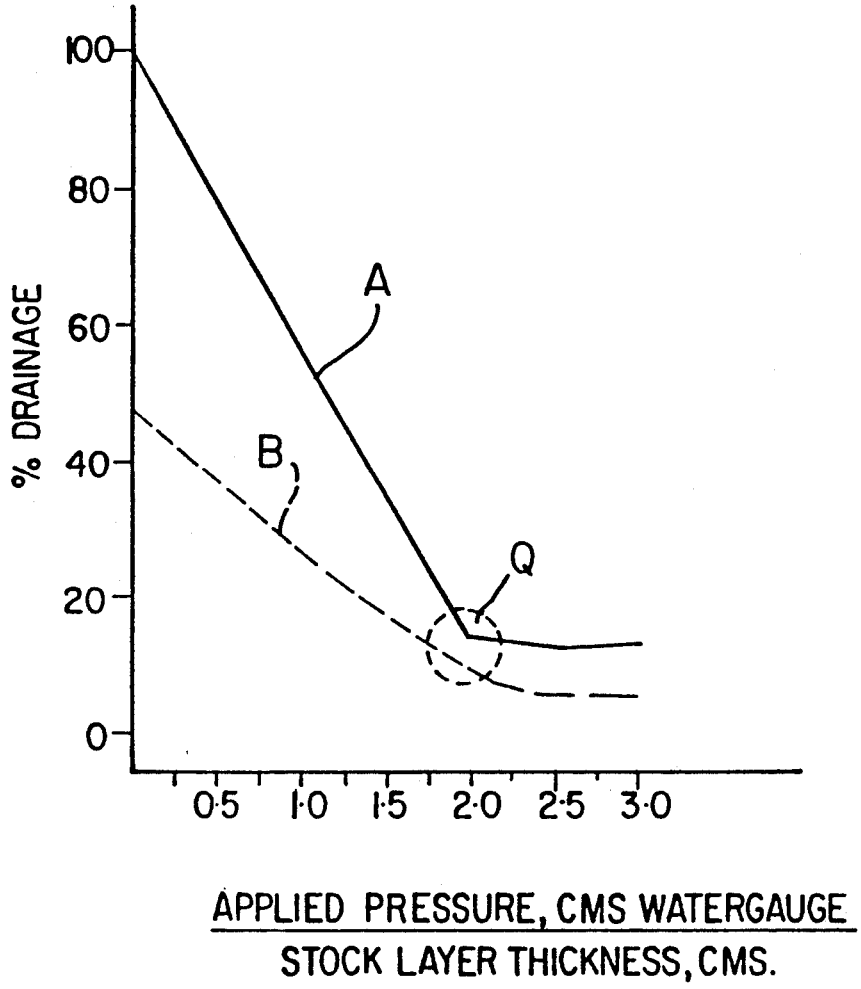
FIG. 5 shows schematically the relationship between the applied pressure and the observed drainage rate.

Experiment has shown that the main factors to consider are the permeability of the forming fabric, the blade surface shapes, and the thickness of the stock layer. These will be discussed briefly with reference to FIG. 5. In that Figure, the vertical axis represents a percentage. The 100% point is the drainage rate obtained with no applied pressure. The horizontal axis represents the value of the applied pressure expressed in cms of water gauge as a function of the thickness, in cms, of the stock layer on the forming fabric. Two schematic curves A and B are shown. 'A' may be regarded as a base condition, and 'B' the result of changes:

(i) decreasing the permeability of the forming fabric by using a different fabric design will shift the drainage rate from the A curve toward the B curve;

(ii) increasing the level of agitation being induced in the stock (by changing the blades) again will shift the drainage curve from the A curve toward the B curve;

(iii) in a similar fashion, increasing permeability or decreasing the level of agitation would move the drainage curve in the other direction.

It should also be noted that a change in the stock freeness will move the drainage curve in either direction: a decrease in stock freeness would move the curve from A toward B.

An important part of these curves is the region Q. In both cases, at around this point, the curves flatten out: further applied pressure has little, if any, effect on the drainage rate. This change in the curves occurs when the applied pressure is approaching, but usually somewhat less than, a figure which is effectively twice the stock thickness. In other words, for a stock thickness of 2.5 cms, the area Q will arise at an applied pressure in the range of from more than 2.5 cms to less than 5.0 cms water gauge. The actual figure at which this change will occur will depend on the particular conditions prevailing in a given paper making machine. Currently available data indicates the pressure limit to be no more than twice the stock thickness figure.

Applying this concept to FIG. 2 indicates that for a single drainage box, only a single pressure can be used, and the maximum limiting pressure will be approximately twice the stock thickness at the beginning of the chamber.

FIG. 4 shows a four compartment forming board which allows for the use of a different pressure in each compartment. With this form of construction, the stock layer thickness should be considered separately for each compartment in determining the value of the positive pressure to be applied. The pressure applied generally will decrease away from the head box slice since as drainage occurs the stock layer gets thinner. The pressure in compartment 20 generally will be the highest, and that in 23 the lowest. It is possible that compartment 23, that is the last one in the forming board area, may be operated at ambient atmospheric pressure.

What is claimed is:

1. In a paper making machine having a forming section, including at least a continuous travelling forming fabric which passes over a breast roll adjacent a head box having a head box slice adapted to deliver a jet of aqueous stock onto the forming fabric to provide a layer of stock on the forming fabric, an apparatus for improving paper formation consisting essentially of in combination:

(a) a foraminous forming board support surface for the forming fabric, and which extends from a point adjacent the head box slice;

(b) a drainage means for the foraminous forming board support surface; and (c) an air supply means, including air pressure pump means and air pressure control means whereby the air pressure in the drainage means is controlled;

wherein:

(i) the drainage means extends to the end of the forming board support surface;

(ii) the drainage means is chosen from the group consisting essentially of:

a single drainage box comprising a single compartment provided with an air supply means and an air pressure tight drainage means;

a single drainage box divided into a plurality of separate compartments by a plurality of air tight divisions extending across the width of the drainage box, each compartment of which is provided with a separate air supply means and a separate air pressure tight drainage means; and a plurality of separate contiguously adjacent drainage boxes which in effect form a plurality of separate compartments, each of which extends across the width of the forming fabric, and each of which is provided with a separate air supply means and a separate air pressure tight drainage means;

(iii) the air supply means together with the air pressure tight drainage means is structured and arranged to provide in each compartment an air pressure above ambient atmospheric pressure sufficient to hinder water drainage from the stock through the forming fabric but insufficient to interfere with paper formation on the forming fabric;

(iv) the forming board support surface provides apertures through which the forming fabric drains and a path through which the forming fabric moves which is structured and arranged to cause a controlled level of continuous agitation in the stock on the forming fabric, and provides an air pressure tight seal between each compartment and the forming fabric;

(v) the forming board support surface includes a plurality of static support elements regularly spaced so as to induce agitation in the stock;

(vi) the static support elements comprise a plurality of thin elongate blades having top fabric supporting faces extending across the full width of the forming fabric, together with sealing strips interposed between the ends thereof adjacent the lateral edges of the fabric;

(vii) the static support elements include at least one static support element having a top support face for the forming fabric which contributes to the desired level of agitation in the stock, and which comprises a flat surface having a leading and a trailing portion in the direction of forming fabric travel separated by at least one shallow depression extending along the blade for the width of the forming fabric and wherein each of the leading and trailing portions, and of any flat portions intermediate shallow depressions, is of sufficient width in the direction of forming fabric travel to provide a hydraulic seal to the forming fabric; and (viii) one of the plurality of thin elongate blades is placed above the first and the last walls of the drainage means, and over any internal transverse division or pair of contiguous transverse walls in the drainage means; and (ix) the air supply means is structured and arranged to provide an air pressure in the or each compartment which is less than twice the thickness of the layer of stock on the forming fabric above the or each compartment, the thickness of the stock being measured in centimeters and the pressure in centimeters water gauge.

2. Apparatus according to claim 1 wherein the drainage means comprises a single drainage box having a single compartment.

3. Apparatus according to claim 1 wherein the drainage means comprises either a drainage box divided into a plurality of separate compartments, or a plurality of separate contiguously adjacent drainage boxes which in effect form a plurality of separate compartments.

4. An apparatus according to claim 2 wherein all of the thin elongate blades are of the same width.

5. An apparatus according to claim 3 wherein all of the thin elongate blades are of the same width.

6. An apparatus according to claim 2 wherein the first thin elongate blade, adjacent the headbox slice, is wider than the remainder, and wherein all of the remaining blades are of the same width.

7. An apparatus according to claim 3 wherein the first thin elongate blade, adjacent the headbox slice, is wider than the remainder, and wherein all of the remaining blades are of the same width.

8. An apparatus according to claim 2 wherein the top support face has only one shallow depression.

9. An apparatus according to claim 3 wherein the top support face has only one shallow depression.

10. An apparatus according to claim 2 wherein the top support face has two shallow depressions, and further wherein each depression is about the same width, each of the leading, trailing, and intermediate flat portions are about the same width, and each of them are about one half of the width of the depressions.

11. An apparatus according to claim 3 wherein the top support face has two shallow depressions, and further wherein each depression is about the same width, each of the leading, trailing, and intermediate flat portions are about the same width, and each of them are about one half of the width of the depressions.

12. An apparatus according to claim 8 further including at least one static support element having a substantially flat top surface.

13. An apparatus according to claim 9 further including at least one static support element having a substantially flat top surface.

14. An apparatus according to claim 10 further including at least one static support element having a substantially flat top surface.

15. An apparatus according to claim 11 further including at least one static support element having a substantially flat top surface.

16. An apparatus according to claim 8 wherein the shallow depression extends for about one half of the width of the blade.

17. An apparatus according to claim 16 wherein each of the leading and trailing portions are about one quarter of the width of the blade.

18. An apparatus according to claim 9 wherein the shallow depression extends for about one half of the width of the blade.

19. An apparatus according to claim 18 wherein each of the leading and trailing portions are about one quarter of the width of the blade.

20. An apparatus according to claim 2 wherein in the forming board support surface, all of the static support elements are regularly and uniformly spaced.

21. An apparatus according to claim 3 wherein in the forming board support surface, all of the static support elements are regularly and uniformly spaced.

22. An apparatus according to claim 2 wherein, in the forming board support surface, the static support elements are in contiguous groups and wherein the static support elements within each group are regularly spaced; and the spacing within any one group is not the same as the regular spacing of the static support elements in an adjacent group.

23. An apparatus according to claim 3 wherein, in the forming board support surface, the static support elements are in contiguous groups and wherein the static support elements within each group are regularly spaced; and the spacing within any one group is not the same as the regular spacing of the static support elements in an adjacent group.

* * * * *